United States Patent [19]

Wu

[11] Patent Number: 5,001,450

[45] Date of Patent: Mar. 19, 1991

[54] CIRCUIT BREAK SWITCH

[76] Inventor: Shih-Liang Wu, No. 62, Ta An Street, Tainan, Taiwan

[21] Appl. No.: 390,996

[22] Filed: Aug. 9, 1989

Related U.S. Application Data

[63] Continuation-in-part of Ser. No. 217,895, Jul. 12, 1988, abandoned.

[51] Int. Cl.[5] ..... H01H 71/16

[52] U.S. Cl. ..... 337/68; 337/66

[58] Field of Search ..... 337/66, 68, 113, 414, 337/79

[56] References Cited

U.S. PATENT DOCUMENTS

| | | | |
|---|---|---|---|
| 1,373,128 | 3/1921 | Freese | 337/68 |
| 2,704,312 | 3/1955 | Mang | 337/91 |
| 2,866,034 | 12/1958 | Dillon | 337/66 |
| 4,123,737 | 10/1978 | Hoagland, Jr. | 337/68 |
| 4,347,494 | 8/1982 | Krasser | 337/113 X |
| 4,360,725 | 11/1982 | Eeckhout | 337/414 |
| 4,573,031 | 2/1986 | Krasser | 337/68 |
| 4,630,020 | 12/1986 | Yang | 337/79 |
| 4,682,138 | 7/1987 | Sell | 337/68 |
| 4,814,739 | 3/1989 | Moldovan | 337/66 X |

*Primary Examiner*—J. R. Scott

*Attorney, Agent, or Firm*—Lowe, Price, LeBlanc, Becker & Shur

[57] ABSTRACT

This invention relates to a circuit breaker switch having a cover, a housing, two copper plates, a bimetallic blade, a push button and a push rod, wherein the bimetallic blade acts as a bridging contact between the two copper plates at a rated current to conduct electricity. When there is a current overload, the bimetallic blade, because of its character, will bend and depart from the two copper plates to cut off current. The circuit may be open even if the current is not at an overload value by a user pushing the push rod inwardly to separate the bimetallic blade from the two copper plates when necessary. The contact points of the two copper plates are caused to stay in a switch-disengaging position by action of an insulating plate.

1 Claim, 6 Drawing Sheets

CIRCUIT BREAK SWITCH

This application is a continuation-in-part application of my earlier application, Ser. No. 07/217/895, filed on July 12, 1988, now abandoned.

BACKGROUND OF THE INVENTION

This invention relates to an automatic circuit breaker switch which utilizes an extended actuation portion of a bimetallic blade and a push rod in an automatic circuit breaker, that may be cut off manually.

BACKGROUND OF THE PRIOR ART

A known circuit breaker (shown in FIG. 6) has a cover 91, a housing 92, two copper plates 93*a*, 93*b*, a bimetallic blade 94, a compression spring 95, and a push button 96. The two copper plates 93*a* and 93*b* are installed on the housing 92 and one end of the copper plate 93*a* is riveted with one end of the bimetallic blade 94 while the other end of the bimetallic blade 94 has a silver contact point 941 which touches a contact point 931 constantly. The push button 96 has an isolating plate 961 at one end and is placed in the housing 92. The compression spring 95 is placed between .the end of the push button 96 and the inner wall of the housing 92. When in a normal situation, the silver contact point 941 of the bimetallic blade 94 is in contact with the contact point 931 of the copper plate 93*a* and the isolating plate 961 is pushed by the compression spring 95 to move forward but is stopped by the two contact points 941 and 931. However, if there is a current overload, the bimetallic blade 94, because of its character, will bend and cause the contact point 941 to separate from the contact point 931 of the copper plate 93*b*, and the isolating plate 961 of the push button will be pushed forward by the compression spring 95 and stick in between the two contact points 941 and 931 to cut off current flowing. The bimetallic blade 94, after current is cut off by the isolating plate 961, will cool down gradually and return to its original shape. In the meantime, upon pushing of the knob of the push button 96 inwardly the isolating plate 961 will leave the two contact points 941 and 931 and the silver contact point 941 of the bimetallic blade 94 will be in contact with the contact point 931 of the copper plate 93*b*; thus the circuit is on again. However, such a circuit breaker can be cut off automatically only when current is on overload and can not be cut off manually when electricity is not in use, otherwise it has to combine a power switch in series.

The present invention provides a circuit breaker switch which can cut off current both automatically and manually.

SUMMARY OF THE INVENTION

It is a primary object of this invention to provide a circuit breaker switch that may be operated to cut off power manually to save energy and will also cut off power automatically for safety.

It is another object of the present invention to provide a circuit breaker switch that will cut off power automatically when there is a current overload.

It is still another object of the present invention to provide a circuit breaker switch which is inexpensive to produce.

It is a further object of the present invention to provide a circuit breaker switch which is easy to operate.

DETAILED DESCRIPTION OF THE PREFERRED EMBODIMENT

Figure 1:
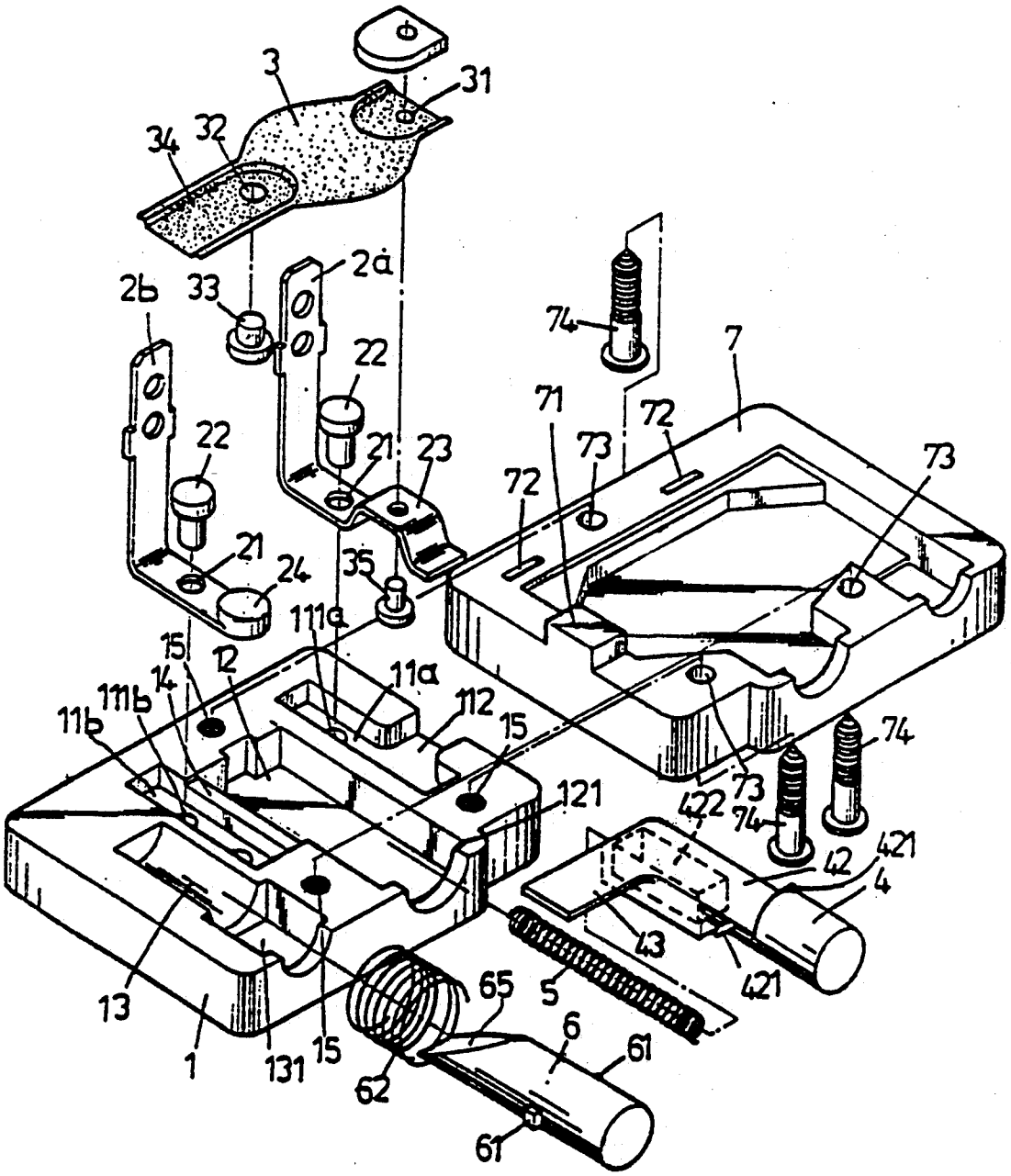
FIG. 1 is an exploded view of the present invention.

The present invention, according to FIG. 1, comprises a structure known in the prior art which is described in background with certain changes, such as the push rod 6 which is cylindrical in shape, has two protuberances 61 at two diametrally opposite positions, an inclined end 65, and a compression spring 62. The two protuberances 61 are used to stop the push rod 6 from sliding through the compression spring 62. The compression spring 62 has one end placed against the inner wall of a push rod trough 13 and the other end stopped by the two protuberances 61.

A further difference with the prior art is that the end of the silver contact point 33 of the bimetallic blade 3 has an extended actuation portion 34 which is to be pushed upwardly by the inclined end 65 of the push rod 6 to move the silver contact point 33 away from the contact point 24 to cut off current flow when necessary.

Reference is now made to the structure illustrated in FIG. 1 which comprises a housing 1, two copper plates 2*a* and 2*b*, a bimetallic blade 3, a push button 4, a compression spring 5, an push rod 6, a compression spring 62 and a cover 7. The housing 1 is in a square shape and has several troughs which are, as identified from the right to the left in FIG. 1, a copper plate trough 11*a*, a push button trough 12, a copper plate trough 11*b* and a push rod trough 13.

The copper plate trough 11*a* has a rivet hole 111*a* at front and a mortise 112 at its right-hand side. The push button trough 12 expands all the way back to the rear edge of the housing 1 and a portion close to the rear edge is made smaller than the rest of the trough 12 and forms a lap 121. The copper plate trough 11*b* has a rivet hole 111*b* at its front and the wall that divides the copper plate trough 11*b* and the push button trough 12 has been cut out a portion on its top and formed a sliding trough 14.

The push rod trough 13 also expands all the way back to the rear edge and at the rear end of the trough 13 there is formed a spring chamber 131 which is wider than the rest of rod trough 13. The housing 1 further has three screw holes 15 which are for assembling housing 1 with the cover 7.

The two copper plates 2*a* and 2*b* are both shaped like the letter "L" and each has a rivet hole 21 at a horizontal part for fixing the respective copper plates on the two copper plate troughs 11*a* and 11*b* with rivets 22. The horizontal part of the right-hand side copper plate 2*a* has a connection at a portion 23 of the bimetallic blade 3 and the left-hand side copper plate 2*b* has a connect point 243 at a horizontal part end.

The bimetallic blade 3 is composed of two sheets of metal each of which has a different expansion coefficient. One end of the bimetallic blade 3 has a rivet hole 31 for connection with the connection portion 23 of the copper plate 2*a* with a rivet 35. A hole 32 is provided close to the center of blade 3 for fixing a silver contact point 33 and the other end is an extended actuating end 34.

A push button 4 extends out of the housing 1 and the cover 7 when they are assembled. The front end of the push button 4 has a guiding part 42 which slides in the push button trough 12. The guiding part 42 has two protuberances 421 at opposite sides and a recess 422 at the bottom to accommodate a compression spring 5 which has one end placed against the wall of the push button trough 12 and another end placed against the recess 422 to provide an elastic bias force on the push button 4. The push button 4 further has an insulating plate 43 which slides in the sliding trough 14.

Push rod 6 has a cylindrical shape having a slope 65 cut at one end and two protuberances 61 at opposite sides to serve as a stopper to stop a compression spring 62 from passing around push rod 6. The ring 62 has one end placed against the ring chamber 131 of the push rod trough 13 and another end placed against the two protuberances 61 so as to provide an elastic bias force to the push rod 6.

Cover 7 has an adequate recess which allows the cover 7 to be securely assembled with the housing 1. See FIG. 1. The cover 7 further has a tenon 71 which will fit with the mortise 112 of the copper plate trough 11A, two slots 72 which will allow the vertical part of the two copper plates 2*a* and 2*b* to pass through, and three screw holes 73 which, by using three screws 74, will connect the housing 1 and the cover 7 securely.

Figure 2A:
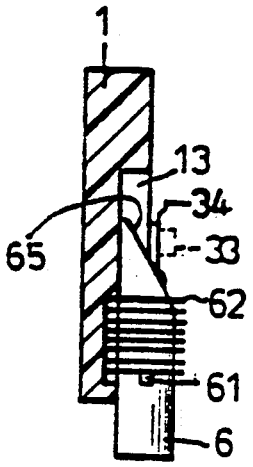
FIGS. 2A, 3A and 4A are side cross-sectional views of the push rod of the present invention.
Figure 2B:
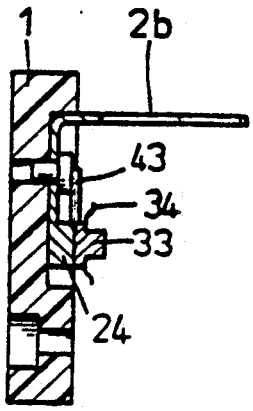
FIGS. 2B, 3B and 4B are side cross-sectional vies of the copper plate of the present invention.
Figure 2C:
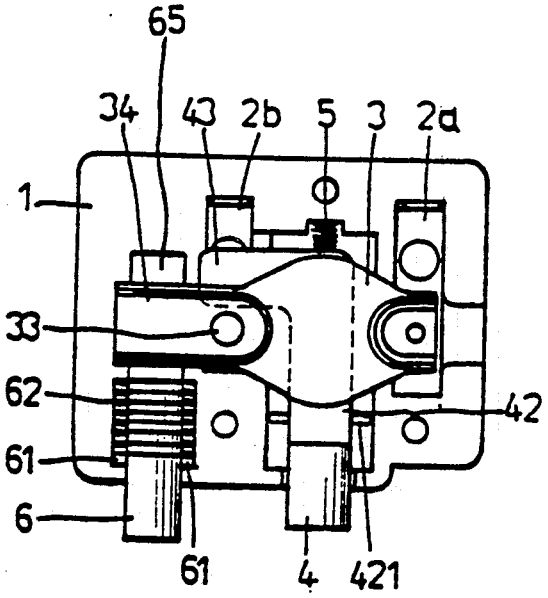
FIGS. 2C, 3C and 4C are plan views of the present invention.
Figure 3A:
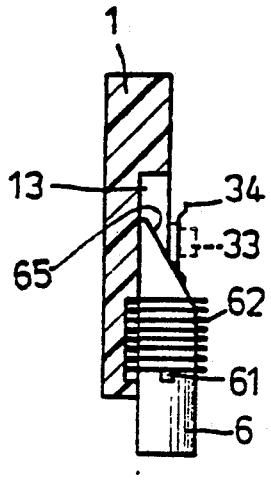
Figure 3B:
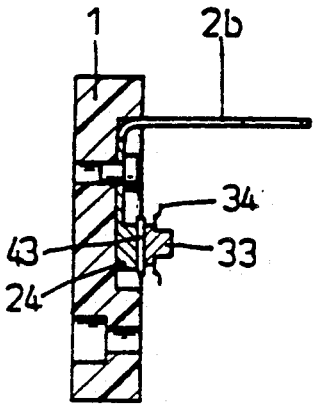
Figure 3C:
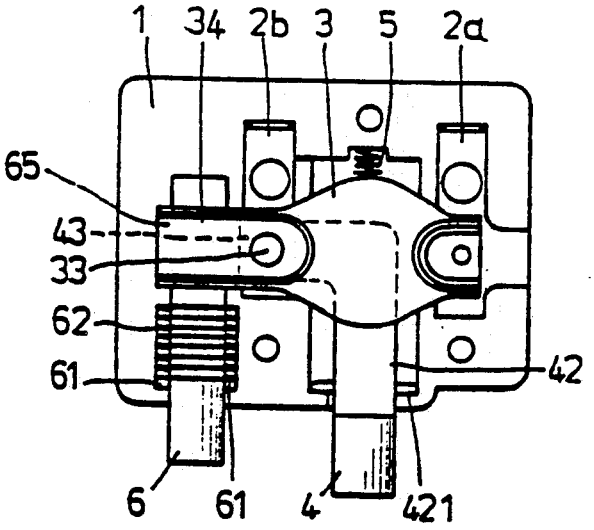

More details of the structure can be obtained from the following drawings. FIG. 2A and 2B are cross-sectional views showing the circuit in a normal situation. FIG. 2A shows that the push rod 6 has not been pushed in and the isolating plate 43, shown as in FIG. 2B and 2C, is separated from the two contact points 33 and 24. FIG. 3A and 3B are cross-sectional views, FIG. 3C is a plan view, and they show the circuit in its open situation.

When there is a current overload, the bimetallic blade 3 will bend because of this bimetallic character, and the silver contact point 33 will depart from the contact point 24 of the copper plate 2*b*. The isolating plate 43 is then pushed by compression spring 5 forwardly and is inserted onto the silver contact point 33 of the bimetallic blade 3 and the contact point 24 of the copper plate 2*b*, and thus power is cut off. The push rod 6 at this moment still remains unmoved.

Figure 4A:
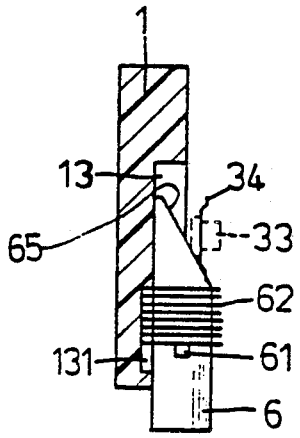
Figure 4B:
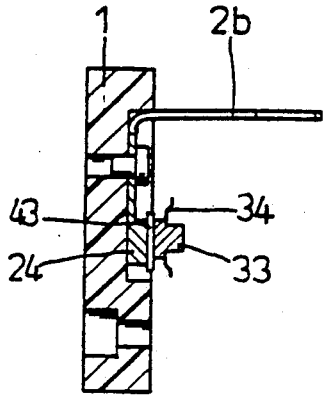
Figure 4C:
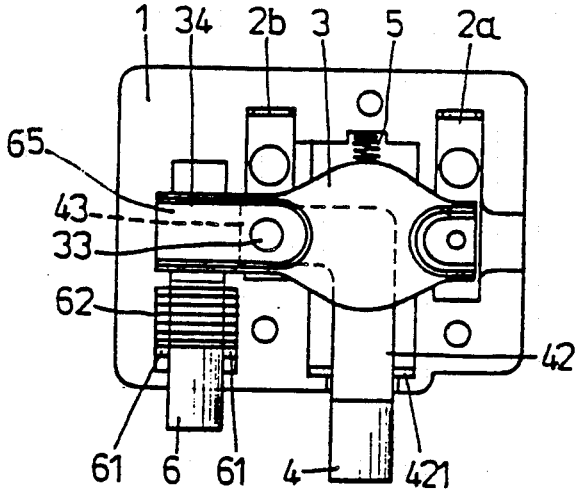
Figure 5:
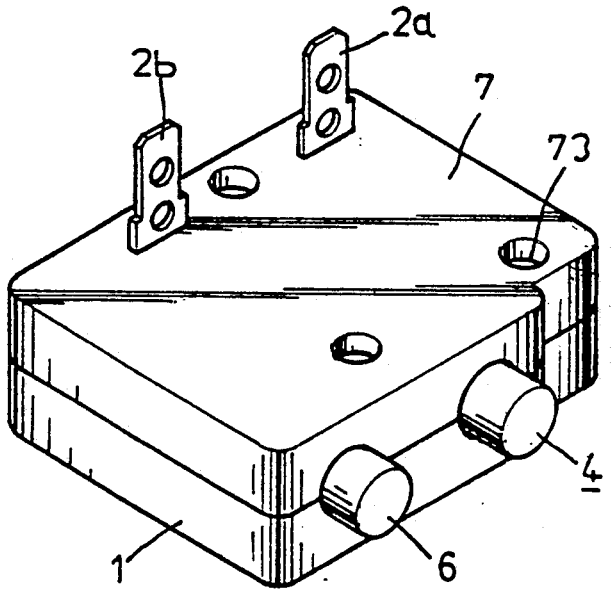
FIG. 5 is a perspective view of the present invention.
Figure 6:
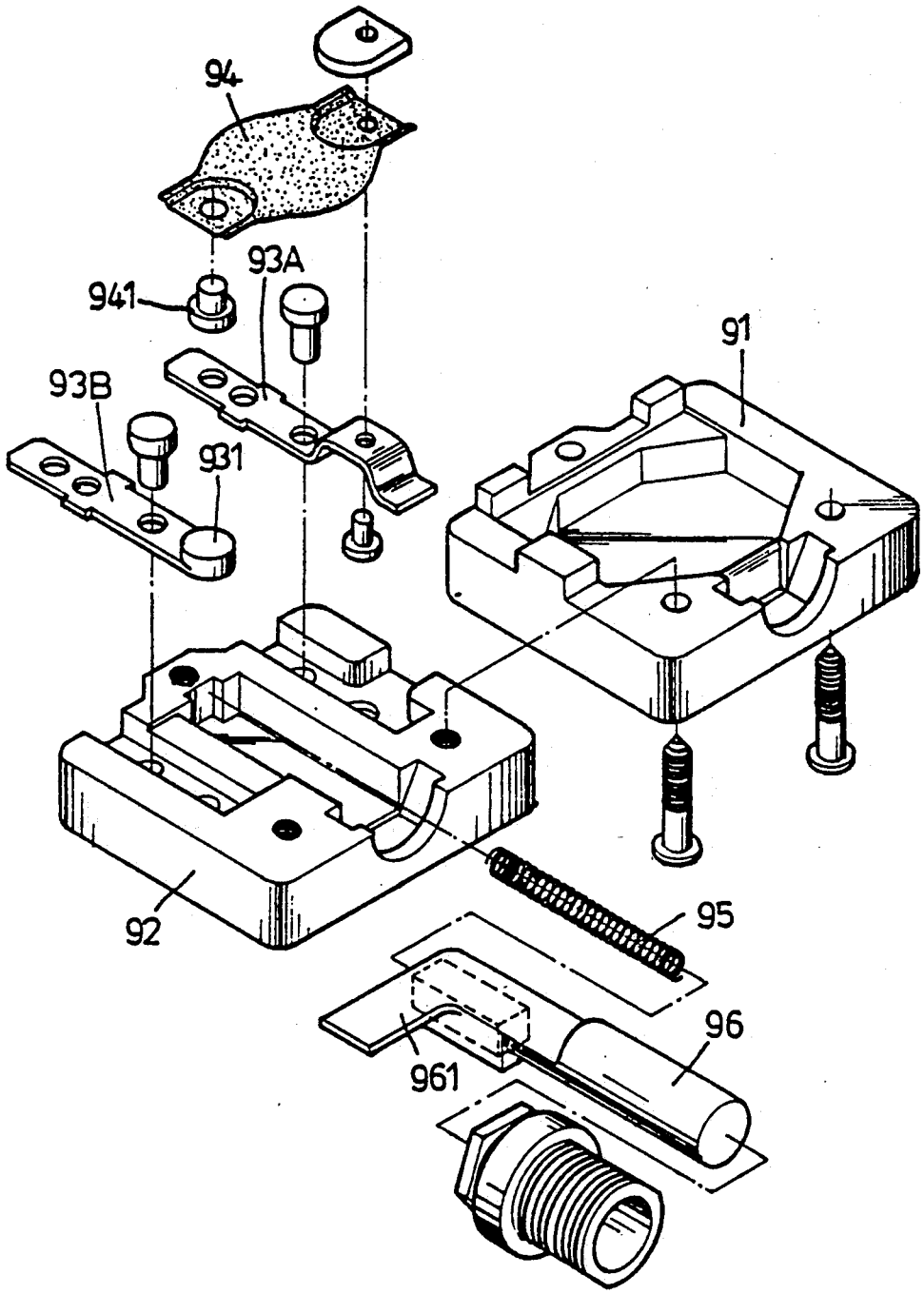
PRIOR ART FIG.6
FIG. 6 is an exploded view of a circuit breaker switch known in the prior art.

FIGS. 4A, 4B and 4C show different operating positions of the switch. The push rod 6, according to the FIG. 4A, has been pushed forward, and the inclined end 65 of the push rod 6 will push the actuating portion 34 to move it upward gradually and, when the space thus opened is wider than the thickness of the isolating plate 43, the isolating plate 43, because of the elastic force of the compression spring 5, will be pushed into the opened space. The push rod 6, while the isolating plate 43 is inserted into the space between the silver contact point 33 and the contact point 24, can be released and the compression spring 62 will push the push rod 6 to return it to its original position. The power is thus cut off manually.

To restore power, it is only necessary to push the push button 4 inwardly and the isolating plate 43 will move inwardly with the push button 4 and the silver contact point 33 can be in touch with the contact point 24, and the circuit is thus closed again.

Still other objects and advantages of the present invention will become readily apparent to those skilled in this art from the preceding detailed description, wherein only the preferred embodiment of the invention is illustrated and described, as aforementioned, simply by way of presenting the best modes contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive, the invention being defined solely by the claims appended hereto.

I claim:

1. A thermal and manually operated circuit breaker switch, comprising:

a housing, having a first copper plate trough, a push button trough, a second copper plate trough and a push rod trough, disposed in order from a first end;

first and second plates respectively placed in said first and second copper plate troughs, said first copper plate having a contact point;

a bimetallic blade affixed at one end to said second copper plate, the center of said bimetallic plate having a silver contact point engaging said contact point of said first copper plate, said silver contact point having an extended actuation portion;

a push button placed in said push button trough, with an isolating plate extending from one side of said push button and slidable therewith;

a push rod placed in said push rod trough, a first end of said push rod having an inclined portion, two protuberances being provided at two opposite sides of said push rod;

first and second compression springs located in said push button trough and said push rod trough, providing respective bias forces to said push button and said push rod; and a cover located on said housing, whereby manual pushing of said push rod causes engagement of said inclined portion with said extended actuation portion of said silver contact point of said bimetallic blade by a surface of said inclined portion thereof, thereby causing said bimetallic blade to be moved away from said contact point of said first copper plate to enable cut off of a current flowing between said first and second copper plates by the insertion of said isolating plate of said push button between said contact points of said contact plates.

* * * * *